US006640740B1

(12) United States Patent
French et al.

(10) Patent No.: US 6,640,740 B1
(45) Date of Patent: Nov. 4, 2003

(54) BOTTOM ACTIVATED RETRACTABLE CONTROL SURFACE FOR AN UNMANNED UNDERSEA VEHICLE

(75) Inventors: Daniel W. French, Portsmouth, RI (US); John J. Vaillancourt, Tiverton, RI (US); Thomas W. Hedly, Jr., Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/214,483

(22) Filed: Aug. 5, 2002

(51) Int. Cl.[7] ..... B63G 8/14
(52) U.S. Cl. ..... 114/330; 114/332
(58) Field of Search ..... 114/330, 332, 114/132

(56) References Cited

U.S. PATENT DOCUMENTS 1,250,987 A * 12/1917 De Graw ..... 114/332
3,093,105 A * 6/1963 Rebikoff ..... 114/332
4,883,436 A * 11/1989 Oakland ..... 441/65
5,467,728 A * 11/1995 Lucy et al. ..... 114/332

* cited by examiner

*Primary Examiner*—Jesus D. Sotelo
(74) *Attorney, Agent, or Firm*—James M. Kasischke; Michael F. Oglo; Jean-Paul A. Nasser

(57) ABSTRACT

A bottom activated retractable control device includes a fin member having a front edge, a trailing edge opposite to the front edge, a bottom edge between the front edge and the trailing edge, and an arm portion extending from and coextensive with the leading edge and away from the bottom edge. The arm portion includes a pivot pin extending in a perpendicular direction from each side of the arm portion. A pivot housing having an aperture is provided for receiving the pivot pin of the arm portion, the housing enabling both a vertical pivot of the fin member upon contact of the fin with, an object and axial rotation of the fin about the arm portion of the fin member. A well is formed in the bottom surface of an underwater vehicle corresponds in depth to a fully retracted position of the fin member and in width to any rotated position of the fin member. A spring member is joined between the pivot housing and the pivot pin, the spring member normally biasing the fin member away from the vehicle, the fin member pivoting into as much as an entirety of the well in response to a force against the control fin.

7 Claims, 3 Drawing Sheets

BOTTOM ACTIVATED RETRACTABLE CONTROL SURFACE FOR AN UNMANNED UNDERSEA VEHICLE

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

Not applicable.

BACKGROUND OF THE INVENTION (1) Field of the Invention

This invention generally relates to a bottom activated retractable control surface for unmanned undersea vehicles.

More particularly, the invention relates to a bottom activated retractable control surface for unmanned undersea vehicles which is automatically retractable without user intervention.

(2) Description of the Prior Art

The current art for control fins on an unmanned undersea vehicle is not in question. However, the manner of retracting and deploying these control fins has not been addressed in the manner of the present invention. At the present time, if an unmanned undersea vehicle needs to rest on the bottom of the ocean, a standard control fin mounted on the underside of the vehicle can be seriously damaged due to this maneuver and its resulting contact on the ocean floor.

Thus, a problem exists in the art whereby damage occurs to the fins of the underwater vehicle during bottom maneuvers. The invention allows the lower quadrant fin(s) to retract as the unmanned underwater vehicle settles on the ocean bottom. Also when the vehicle is on the surface, the invention gives the capability of controlling surface maneuvering.

The following patents, for example, disclose various types of fins or rudders for underwater vehicles, but do not disclose automatically retractable fins as occurs in the present invention.

U.S. Pat. No. 1,246,475 to Schneider;

U.S. Pat. No. 3,093,105 to Rebikoff;

U.S. Pat. No. 3,752,105 to Hackett;

U.S. Pat. No. 3,805,540 to Crabille;

U.S. Pat. No. 3,902,441 to Scholle; and

U.S. Pat. No. 5,235,926 to Jones.

Specifically, the patent to Schneider discloses a submerging rudder for submarines. In particular, the device therein is for the purpose of causing submerging rudders of submarines to disappear or to be retracted during the periods in which they are not required to operate, and thus diminishing as far as possible the resistance offered by them to the progress of the vessel or partly into the interior of the hull. According to this invention the rudders which are capable of being retracted into a recess in the interior of the hull of the vessel, are rendered capable of pivoting, that is to say, of operating by rotation, after their protrusion from the said recess. For this purpose the rudder blade is mounted on a rudder shank which can be kept permanently retracted, and on which the rudder blade is adapted to slide for the purposes of being protruded and retracted. The rotation of the rudder shank carries around with it the sliding rudder blade and thus allows of rotating the latter for steering purposes as desired as soon as it has been moved out into its position of complete protrusion. Although the rudder retracts into the submarine, it does not automatically operate during an impact of the rudder against an obstacle. Instead, the rudder is manually retracted.

Crabille relates generally to boat rudders, and more specifically to an automatic flip-up rudder for use on air-boats and other boats wherein the rudder is the sole object which protrudes beneath the hull. The rudder is adapted to yieldably pivot in a vertical plane out of engagement with any obstruction which may be encountered. The rudder is mounted such that it will be automatically returned to an effective operating position after passing over the obstruction. Further, it should be understood that Crabille is a spring-loaded rudder that can "break away" when striking an object and retract automatically when the object has been cleared. The retraction is exterior to the vehicle due to placement of the rudder at the outset, and any retraction/restoration does not affect the external volume of the vehicle. Instead, the rudder remains within the volume of water and does not alter the flowline of the vehicle.

The patent to Rebikoff relates to an arrangement applicable to submarine vessels in which there is provided a submarine vessel having a pair of fins (or hydroplane) for controlling the descent and ascent and stability of the vessel, wherein each fin is articulated about an axis substantially perpendicular to the plane of the fin, whereby the fin can fold back partially or wholly against the vessel on striking an obstacle against the action of resilient means which normally hold the fin in its proper position. The fins fold back when they strike an obstacle and once the obstacle has been cleared, regain their original position under the action of a restoring spring or equivalent means. When the fins are retracted totally or even partially, their action is evidently different from that in their normal position. The fins are always parallel to the direction of movement. The shock causing retraction is therefore always perpendicular to the shaft at which the fin is articulated and there is therefore no risk of deformation of this shaft. This patent, however, does not allow the fins to retract fully into the body of the vehicle. If bottom operation were desirable, the fins taught by Rebikoff cannot completely recess into the vehicle and damage would likely occur. Also, the fin could still interfere with an obstacle since the surfaces are still "exposed" when retracted.

The patent to Hackett discloses a rudder construction for small boats, particularly sail boats, in which the rudder is mounted on its rotatable support arm for pivotal movement on a horizontal axis to prevent damage to the rudder in the event that it strikes an obstruction in the water. A detent means yieldably retains the rudder in its normal vertical position or a horizontal or intermediate position. The tiller may be manipulated to move the rudder to any of a plurality of positions. More specifically, the design relates to a surface craft rudder that will move up into a set number of preset notches in the design. The device does not automatically return into its operating position after object impact and instead must be manually returned to an operating position. Further, the notched positions limit the number of positions of the rudder and an infinite number of positions within the fully extended and fully retracted range are not obtainable.

Scholle discloses a sailboat having retractable and self-ejectable hydraulic controls. A small lightweight sailboat of the type readily transported in passenger vehicles such as station wagons and the like is provided with hydraulic controls integrally and movably coupled to the hull of the sail-boat. The hydraulic controls comprise rudder and centerboard assemblages, each of which are pivotally coupled to the hull of the sailboat in a manner enabling them to be retracted and self-ejected when maneuvering the boat through shallow waters or over submerged obstacles. Due to the manner in which these hydraulic control assemblages are pivotally coupled to the hull of the sailboat, they can be fully retracted within the sailboat hull and onto the deck of the sailboat and secured in their fully retracted positions for storage when the sailboat is not in use or when preparing the sailboat for overland transport. Retraction and storage of the rudder assemblage is achieved by pivotally mounting the rudder at the stern of the sailboat in a manner which permits the rudder to be rotated onto and laid flat upon the deck. Retraction and storage of the centerboard assemblage is achieved by pivotally mounting a centerboard within a removable centerboard trunk in a manner which permits the centerboard to be locked within the centerboard trunk and released therefrom by controls housed within the trunk. Thus, the rudder hinges upward upon obstacle impact but does not return to operating position automatically. Although the centerboard does spring load in the retracted position upon an obstacle impact, manual intervention must be used to put the centerboard back in an operation position when reaching a fully retracted position. Further, the centerboard does not rotate for steering and thus cannot retract in a rotated position.

Jones discloses a pair of pivotally attached fins depending into the water below the hull of the boat. When turning maneuvers are executed, the tendency of the boat to skid sideward is resisted by the downwardly engaged fin panels. When underwater objects or the bottom of a body of water are encountered, the leading edge of the fins strike the objects(s), causing the fins to pivot upward to clear the obstacle(s) and then return automatically to the water to provide an extra measure of boating safety. The fins are not used for steering the vehicle and are simply hinged with no spring loading. The stabilizers re-enter the water due to the drag of two small wings extending normally from the stabilizer. These wings will "grab" the water to pull the stabilizers back down into the water. Spring energy is not used herein and the stabilizers cannot rotate for steering.

In view of the prior art, there exists a need for providing a totally autonomous retraction control for a rudder that retracts out of the flow into the hull of the vehicle allowing bottoming of the vehicle with no damage to the rudder. The device should allow both low-speed control and high-speed maneuvering while allowing obstacle avoidance by permitting the rudder to bend out the way of debris.

SUMMARY OF THE INVENTION

Therefore it is an object of this invention to provide a bottom activated control device in an underwater vehicle.

Another object of this invention is to provide a bottom activated control device in an underwater vehicle which retracts fully within the hull of a vehicle.

Still another object of this invention is to provide a bottom activated control fin in an underwater vehicle in which the control fin is automatically retracted into the well portion of the underwater vehicle upon contact of the control fin with an outside force other than fluid.

A still further object of the invention is to provide a bottom activated control fin in an underwater vehicle in which the control fin is automatically retractable even if the control fin is rotated with respect to the longitudinal axis of the underwater vehicle.

Yet another object of this invention is to provide a bottom activated retractable control fin for an underwater vehicle which is simple to manufacture and easy to use.

In accordance with one aspect of this invention, there is provided a bottom activated retractable control device in an underwater vehicle. The device includes a fin member having a front edge, a trailing edge opposite to the front edge, a bottom edge between the front edge and the trailing edge, and an arm portion extending from and coextensive with the leading edge and away from the bottom edge. A pivot housing is provided for receiving the arm portion of the fin member, the housing enabling both a vertical pivot of the fin member upon contact of the fin with an object and axial rotation of the fin about the arm portion of the fin member. A well is formed in the bottom surface of the underwater vehicle, the well corresponding in depth to a fully retracted position of the fin member and in width to any rotated position of the fin member. A spring member extends through the pivot housing and the arm portion, the spring member normally biasing the fin member away from the vehicle, the fin member automatically retracting into as much as an entirety of the well in response to a force against the control fin.

BRIEF DESCRIPTION OF THE DRAWINGS

The various objects, advantages and novel features of this invention will be more fully apparent from a reading of the following detailed description in conjunction with the accompanying drawings in which like reference numerals refer to like parts, and in which.

DESCRIPTION OF THE PREFERRED EMBODIMENT

In general, the present invention is directed to a bottom activated retractable control surface such as a fin 10 for an undersea vehicle 12, in which the bottom mounted control surface 10 automatically retracts into the body of the vehicle 12.

Figure 1C:
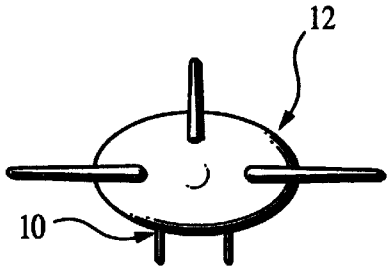
FIG. 1C is an end view of the first preferred embodiment according to FIG. 1A.
Figure 1A:
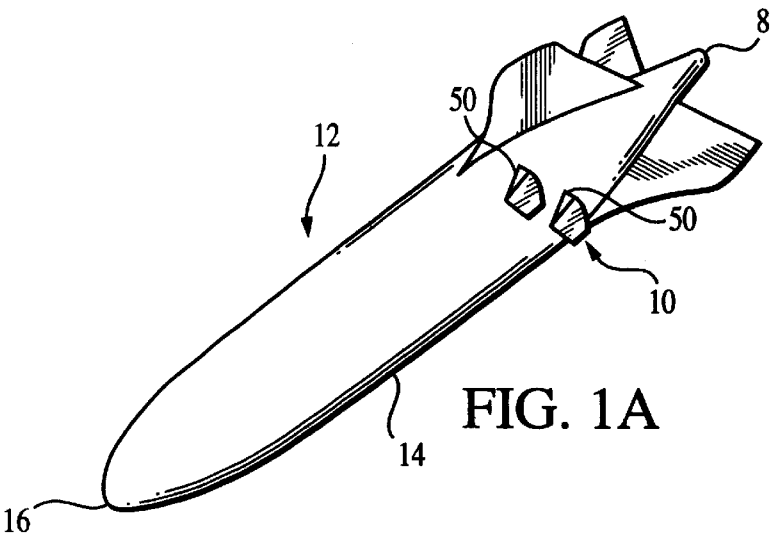
FIG. 1A is a bottom perspective view of a first preferred embodiment of the present invention having retractable control fins.
Figure 1B:
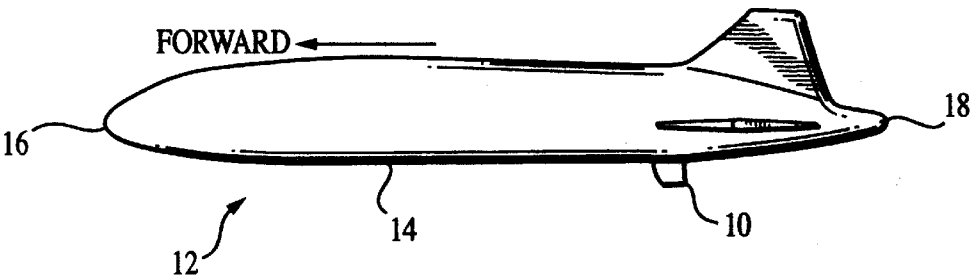
FIG. 1B is a side view of the first preferred embodiment according to FIG. 1A.

Referring first to FIGS. 1A, 1B, and 1C, there is shown an underwater unmanned vehicle 12 having two separate bottom activated control surfaces/fins 10 mounted thereto. The unmanned underwater vehicle 12 is shown in FIG. 1A from a bottom perspective, in FIG. 1B from the side, and in FIG. 1C from an end thereof. The vehicle 12 includes a bottom surface 14, a front end 16, and a rear end 18 opposite that of the front end 16. A well portion 50 is formed in the bottom surface 14 of the vehicle for receiving fins 10 when retracted.

It is intended that this vehicle 12 is designed for bottom operations and the potential damage to the lower control surfaces 10 is significantly reduced (or possibly eliminated) with the retractable feature of the control fins 10. A fixed control surface would be damaged during bottom operations. It should be understood, however, that the scope of this invention is not intended to be limited by the specific example herein and may be applied to other craft which are likely to encounter such resistance.

Figure 2:
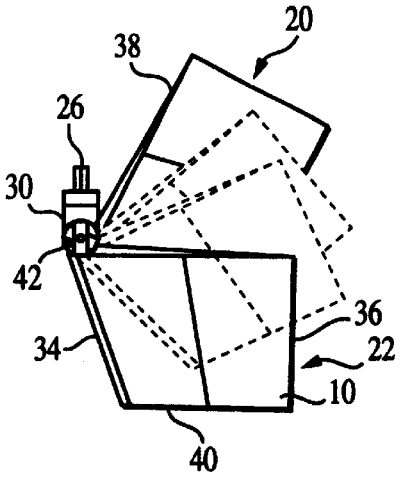
FIG. 2 is a side view showing full vertical rotation of a single control fin according to the preferred embodiment of the present invention.

FIG. 2 illustrates the control fin 10 of the present invention, including a full range of motion thereof. The intent of the graphic is to show the rotational path of the fin 10 from a full-extended position 22 to full-retracted position 24. The normal operating position of the control fin 10 is the extended position 22. The rotation to the retracted position 24 is initiated by contact of the fin 10 with an object or a bottom surface of a body of water and associated with forward and/or vertical motion of the vehicle 12 settling on the bottom.

Figure 3A:
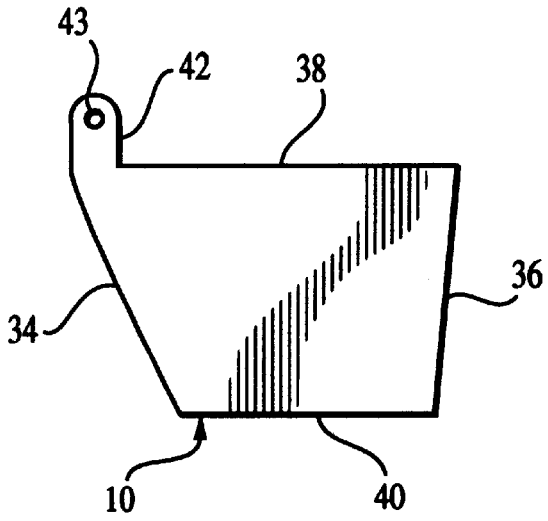
FIG. 3A is a detailed perspective view of a single control fin according to the preferred embodiment of the present invention.

FIG. 3A illustrates additional details of the retractable control surface/fin 10. The control fin 10 includes a leading is edge 34, a trailing edge 36, an upper surface 38, and a bottom surface 40. In the preferred embodiment, each of the upper surface and the bottom surface are substantially parallel to each other. It can be seen from the figures that the fin 10 in fact resembles an airplane fin due the steering and maneuvering capability thereof. In addition, a projection arm 42 extends from the leading edge 34 of the fin 10 at the upper surface 38 thereof. A pivot pin 43 is positioned in the projection arm 42 perpendicular to the plane of fin 10.

Figure 3B:
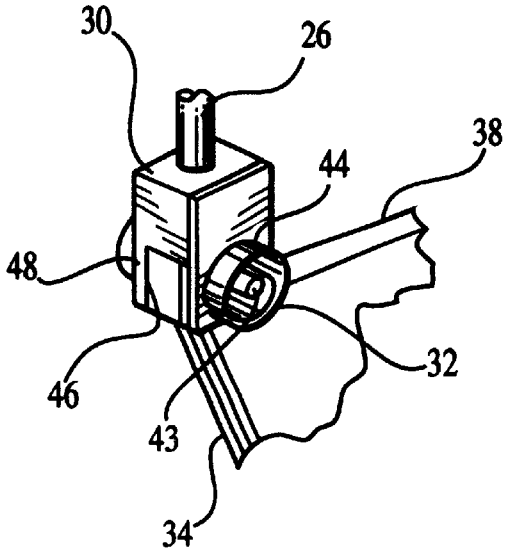
FIG. 3B is a detailed perspective view of the pivot housing of the prevention invention.

Referring now to FIG. 3B, the control fin 10 is mounted to a pivot housing 30 by means of the pivot pin 43 of the control fin 10. The pivot housing 30 and pivot pin 43 are mechanically linked to a torsional spring 32. More specifically, the pivot housing 30 is substantially block shaped and includes a longitudinal hole 44 formed therethrough and a slotted portion 46 at a lower central part thereof. Projection arm 42 extends into slot 46. The slot 46 is defined by depending legs 48 as shown. At the outer sides of the depending legs 48, the pivot pin 43 is rotatably mounted such that the pivot pin 43 extends through the depending legs 48. In a preferred embodiment, torsional springs 32 are joined between pivot pin 43 and housing 30 on each side of housing 30.

The spring 32 is pre-loaded with the control fin 10 in the extended 22 or down position shown. Rotation of the control fin 10 is initiated by forward and/or upward contact of the control fin 10 with an object such as the bottom of the ocean. This contact is mainly due to the vehicle 12 gliding or hovering down to rest on the bottom. The fin 10 is normally biased in the extended position 22.

An actuator (not shown) rotates a control shaft 26 and hence the pivot housing 30 about a vertical axis of the pivot housing 30. The control shaft 26 thus controls rotation of the fin 10 about the control shaft rotation axis. This rotation is controlled by the vehicle. Steering control of the fin 10 is not the intended feature of the present invention and will not be explained further herein. Still further, it should be understood that the "vertical" rotation of the control fin 10 is the result of contact with an external object. It is possible to vertically rotate the control fin 10 while it is in any point of rotation about the vertical axis of the control shaft 26. This is a substantially advantageous feature and one which has not been previously known in the art.

Figure 4A:
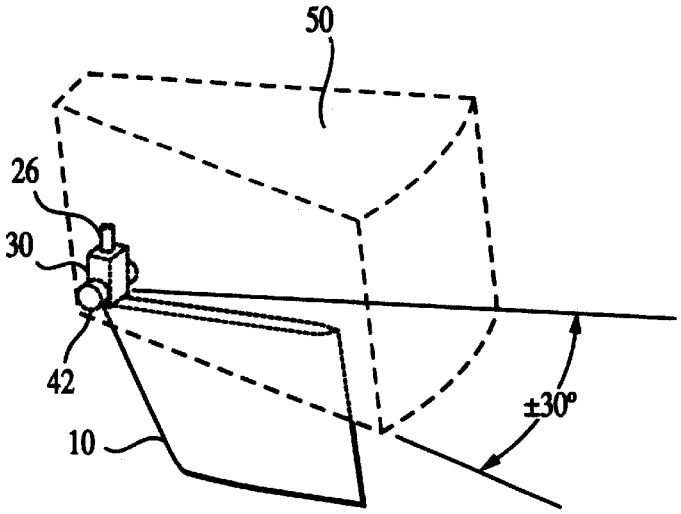
FIG. 4A is a perspective view of a single control fin extending from a vehicle well according to the preferred embodiment of the present invention.
Figure 4B:
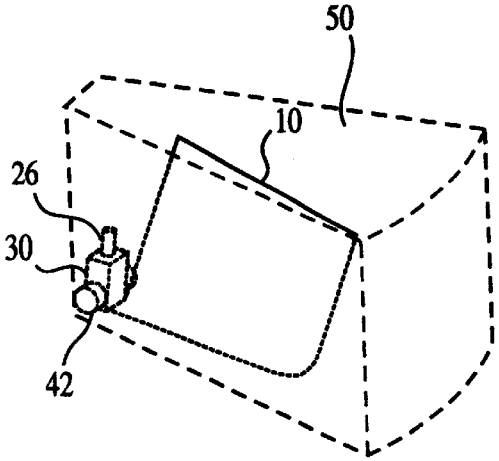
FIG. 4B is a perspective view of a single control fin retracted into the vehicle well according to the preferred embodiment of the present invention.

FIG. 4 illustrates the retraction of the control fin 10 in combination with the well portion 50 of the vehicle 12. The control fin 10 is illustrated in both its extended 22 and retracted 24 position. As described with reference to FIG. 1B, the retraction well 50 is a recessed pocket in the bottom surface 14 of the vehicle 12. The lower portion of the well 50 is flush with the bottom surface 14 of the vehicle 12. The control fin 10 is capable of being completely retracted into the well 50 and protected from damage from the bottom and weight of the vehicle 10. Likewise, retraction of the fin 10 is may be at any of a plurality of retracted degrees depending upon the amount of contact with the fin and a distance away from the object contacted.

The retraction well 50 is shaped in an angular form, which matches the angular sweep of the control fin 10 as rotated by the pivot housing 30 and the control shaft 26. Once again, this feature allows,the control fin 10 to retract into or extend from the well 50 at any angle of fin operation. The control fin 10 does not have to be parallel with the vehicle axis (straight) for it to operate or for it to extend from or retract into the well 50.

Thus, the present invention also allows an unmanned underwater vehicle 12 to have surface capability. The inventive control fins 10 on the bottom of the vehicle 12 give the vehicle rudder control while on the surface of the water. By allowing the control fins 10 to retract, the bottom maneuver can take place without damaging the fins 10.

It will be understood that the torsional spring 32 may be reduced in pre-loaded torque to allow the fin 10 to retract at certain higher speeds of the vehicle 12. Accordingly, the faster the vehicle 12 travels, the more the fin 10 can retract, due to drag on the fin(s). The slower the vehicle 12 travels, then the more the fin 10 will extend due to reduced drag. This alternative is an added bonus, because research has shown that controllability at low speeds is more difficult and the extra extension of fin 10 will provide additional control. The higher speed operations will benefit in efficiency by having the fins 10 retracted and thereby causing less drag on the vehicle 12.

Further, the size of the invention may be changed to accommodate the task and all parts can be enlarged or miniaturized. Spring tension may also be changed to accommodate the task at hand.

Accordingly, it is anticipated that the invention herein will have far reaching applications other than those of underwater vehicles.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A contact activated retractable control device comprising:

at least one fin member having a front edge, a trailing edge opposite to the front edge, a bottom edge between the front edge and the trailing edge, an arm portion extending from and coextensive with the leading edge and away from the bottom edge, and said arm portion having a pivot pin extending in a perpendicular direction from each side of said arm portion;

a rotatable housing having an aperture receiving the pivot pin of said arm portion, said housing enabling both a vertical pivot of said fin member upon contact of the fin with an object and axial rotation of said fin about the arm portion of said fin member;

a vehicle having a well formed in a bottom surface thereof, said well corresponding in depth to a fully retracted position of said fin member and in width to any rotated position of said fin member;

a steering shaft vertically extends from said rotatable housing for controlling a rotation of said housing and thus a direction of said fin about a vertical axis defined by said steering shaft; and a spring member joined between said housing and said pivot pin, said spring member normally biasing said fin member away from said vehicle, said fin member pivoting into as much as an entirety of said well in response to a force against said control fin.

2. The device according to claim 1 wherein said housing includes a longitudinal opening formed therein and a slot for receiving the arm portion of said control fin.

3. The device according to claim 2 wherein the arm portion pivots to move said fin member with respect to said housing from a deployed vertical position to a stored horizontal position.

4. The device according to claim 1 wherein said spring member is external to said housing.

5. The device according to claim 1 wherein said spring member is internal to said housing.

6. The device according to claim 1 wherein said vehicle is an underwater vehicle.

7. The device according to claim 1 wherein said spring member is a torsional spring.

* * * * *